United States Patent [19]

Sainato

[11] Patent Number: 4,798,013

[45] Date of Patent: Jan. 17, 1989

[54] HEADER SIGN MOUNTING ASSEMBLIES FOR PRODUCT MERCHANDISING DISPLAYS

[75] Inventor: Anthony Sainato, Glenview, Ill.

[73] Assignee: Creative Products Merchandising, Elk Grove, Ill.

[21] Appl. No.: 886,090

[22] Filed: Jul. 14, 1986

[51] Int. Cl.[4] ..... G09F 3/18

[52] U.S. Cl. ..... 40/651; 40/124; 211/102; 248/220.4; 248/222.1

[58] Field of Search ..... 248/220.1, 220.2, 220.4, 248/221.1, 221.2, 454, 558; 211/102, 174; 40/10 R, 16, 16.2, 16.4, 124, 490, 491

[56] References Cited

U.S. PATENT DOCUMENTS

| | | | |
|---|---|---|---|
| 1,504,523 | 8/1924 | Sherer . | |
| 1,915,116 | 6/1983 | Barrett | 40/16.6 |
| 2,174,068 | 9/1939 | Citron | 312/252 |
| 2,836,913 | 6/1958 | Thompson et al. . | |
| 3,408,032 | 10/1968 | Francis . | |
| 3,485,382 | 12/1969 | Larson . | |
| 3,929,228 | 12/1975 | Morgolin et al. | 211/102 |
| 4,083,458 | 4/1978 | Young, Jr. | 211/187 |
| 4,303,217 | 12/1981 | Garfinkle | 248/221.1 |
| 4,319,731 | 3/1982 | Pfeifer | 248/223.4 |
| 4,344,244 | 8/1982 | Tyke | 40/611 |
| 4,474,351 | 10/1984 | Thalenfeld | 248/220.4 |

FOREIGN PATENT DOCUMENTS

| | | | |
|---|---|---|---|
| 299007 | 4/1951 | Switzerland | 248/558 |
| 1483450 | 8/1977 | United Kingdom | 211/102 |

*Primary Examiner*—John E. Murtagh
*Assistant Examiner*—Andrew Joseph Rudy
*Attorney, Agent, or Firm*—Tarolli, Sundheim & Covell

[57] ABSTRACT

A mounting assembly for a product merchandising display support a header sign relative to products arranged on a shelf of the display. The mounting assembly includes at least one header sign holder and a pair of laterally spaced members for mounting the header sign holder relative to the shelf. Each member includes an attachment bracket for attaching to a portion of the display. Each member also includes a header holder support bracket and a structure interconnecting the attachment bracket and header holder support bracket to mount the header sign holder relative to the shelf. The interconnecting structure is an upright brace connected at opposite ends with the attachment bracket and header holder support bracket. The upright brace is adjustably connected with the header holder support bracket for angularly varying the mounted relationship of the header sign holder.

6 Claims, 5 Drawing Sheets

FIG.7
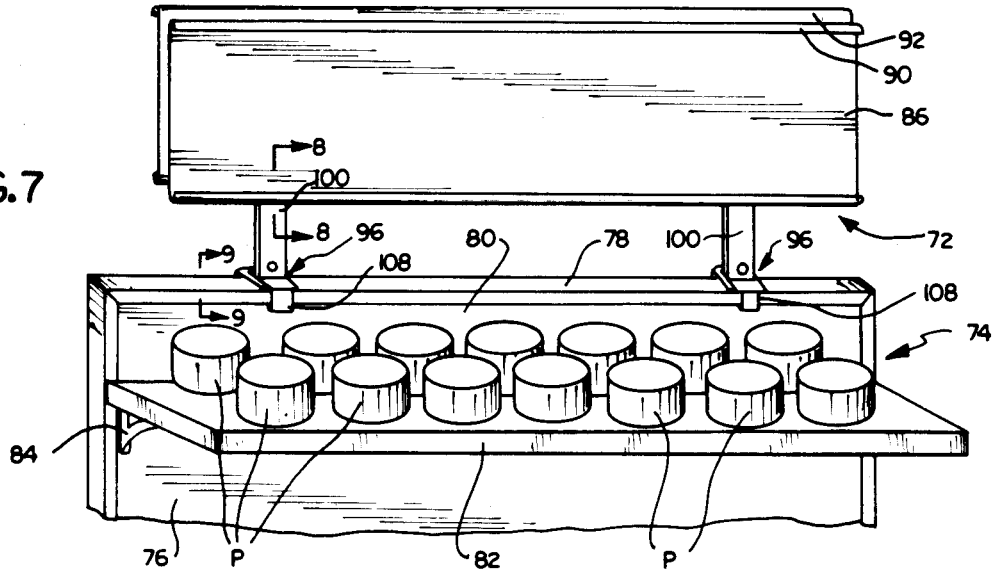
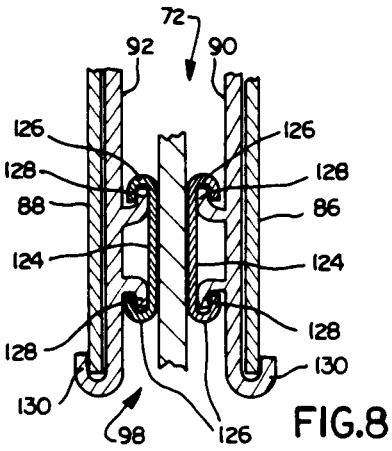
FIG.8
FIG.9
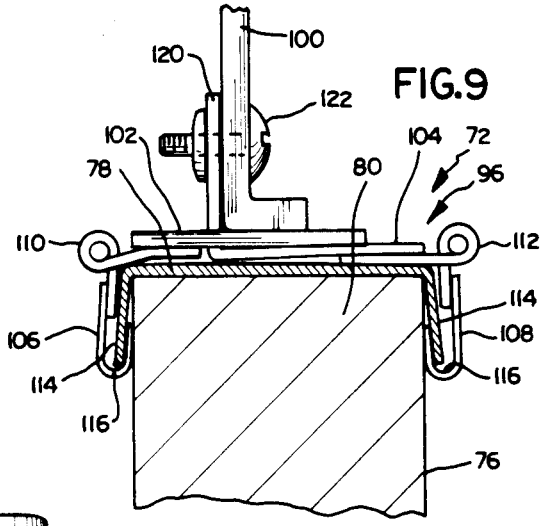
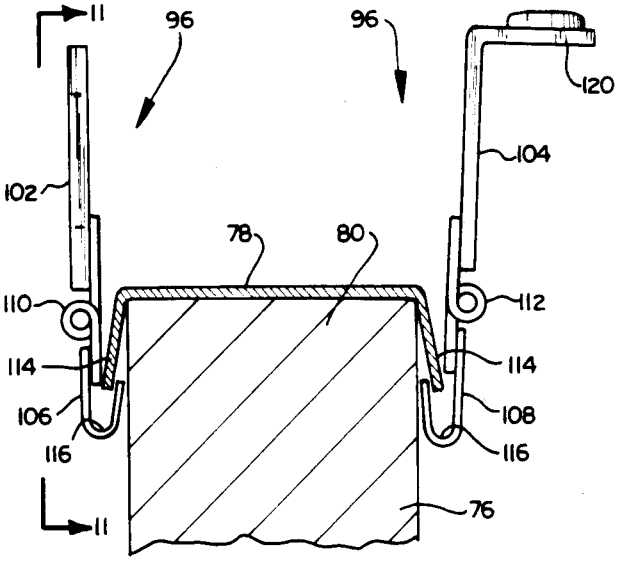
FIG. 10
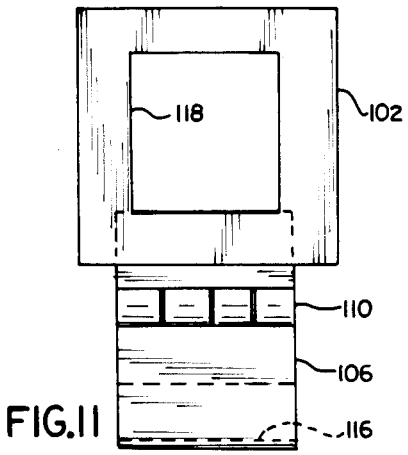
FIG.11

HEADER SIGN MOUNTING ASSEMBLIES FOR PRODUCT MERCHANDISING DISPLAYS

BACKGROUND OF THE INVENTION

1. Field of the Invention

The present invention relates to product merchandising displays and particularly to mounting header signs from supports or shelves used in such displays.

2. Description of the Prior Art

It is known that advertising of a product along with explanatory product information on merchandising displays in stores is an effective way to attract and hold the attention of customers. However, such advertising requires considerable space, which is usually at a premium. Thus, it is an object of the present invention to effectively and efficiently utilize the space available to display products while providing the advertising needed to merchandise the products.

It has been common practice to mount small signs and placards carrying product and price information on a counter, shelf or other display support in conjunction with merchandise. Over the years, many different mounting devices have appeared. Representative of known mounting devices are those disclosed in U.S. Pat. Nos. 1,915,116; 2,174,068; 4,319,731; and 4,344,244. None of the above-cited patents appear to pose a satisfactory solution to the problem of how to present product information advertising which requires a considerable area adjacent the product.

Consequently, a need exists for providing sales-enhancing advertising at product merchandising displays in stores without sacrificing the space needed for product storage.

SUMMARY OF THE INVENTION

The present invention provides several header sign mounting assemblies for product merchandising displays. The header sign mounting assemblies of the present invention mount relatively large header signs above products arranged on shelves of the display. The header sign mounting assemblies of the present invention provide various embodiments adapted to different needs and preferences in arranging merchandising displays.

Accordingly, the present invention is directed to header sign mounting assemblies for a product merchandising display which includes a generally vertical support panel and at least one shelf supported from the panel for arranging the products thereon. Each of the mounting assemblies includes: (a) at least one header holder for holding a display sign; and (b) a pair of laterally spaced members for mounting the header holder relative to the shelf. Each of the laterally spaced members includes a bracket for attachment to a portion of the display, a header holder support bracket for mounting the header holder, and means interconnecting the attachment bracket and the header holder support brackets.

More particularly, a first header sign mounting assembly includes: (a) a header holder for holding a display sign; and (b) at least one member for mounting the header holder above the shelf. The member includes a pegboard attachment bracket, a header holder support bracket, and an upright brace having lower and upper ends. The upright brace is connected at its lower end with the pegboard attachment bracket and at its upper end with the header holder support bracket. Further, the upright brace is adjustably connected at its ends with the pegboard attachment bracket and the header holder support bracket. Adjusting the position of the upright brace relative to the pegboard attachment bracket moves the header sign vertically. Adjusting the position of the upright brace relative to the header holder support bracket moves the header sign angularly.

A second header sign mounting assembly includes: (a) a pair of header holders each for holding at least one display sign; and (b) at least one member for mounting the header holders above the shelf and facing in opposite directions. The member includes a panel top edge clamp, a header holder support bracket, and an upright brace having lower and upper ends. The upright brace is connected at its lower end with the panel top edge clamp and at its upper end with the header holder support bracket. The header holder support bracket has pairs of spaced tracks disposed in back-to-back opposite facing relationship on opposite sides of the upright brace for supporting the header holders.

A third header sign mounting assembly includes: (a) a plurality of header holders each for holding a display sign; and (b) at least one member for mounting the header holders in a generally vertically disposed tandem relationship relative to the shelf. The member includes a shelf attachment bracket, upper and lower header holder supports, and an intermediate header holder support having a first portion connected to the shelf attachment bracket and a second portion disposed between the upper and lower header holder supports. The second portion of the intermediate header holder support is adjustably connected to each of the upper and lower header holder supports for varying the distance therebetween and, thereby, the size of the header holders mounted by the members and the size of the signs held by the header holders.

The third mounting assembly has two forms. In a first form of the third assembly, the first portion of the intermediate header holder support is an upright brace having lower and upper ends. The upright brace is connected at its lower end with the shelf attachment bracket and at its upper end with the second portion of the intermediate header holder support. The upright brace is adjustably connected at its upper end with the second portion of the intermediate header holder support to vary the angular position of the header holders. In a modified form of the third mounting assembly the first portion of the intermediate header holder support is a rigid connection between the shelf attachment bracket and the intermediate header holder support.

Further features of the present invention will become apparent to those skilled in the art to which the present invention relates from a reading of the following specification made with reference to the accompanying drawings, wherein there is shown and described an illustrative embodiment of the invention.

BRIEF DESCRIPTION OF THE DRAWINGS

In the course of the following description, reference will be made to the attached drawings, in which:

FIG. 7 is a perspective view of another product merchandising display having a pair of header signs facing in opposite directions supported on the top edge of a vertical support panel by a second mounting assembly of the present invention;

FIGS. 8–11 are views of the parts of the second mounting assembly of FIG. 7;

DESCRIPTION OF THE INVENTION

Figure 1:
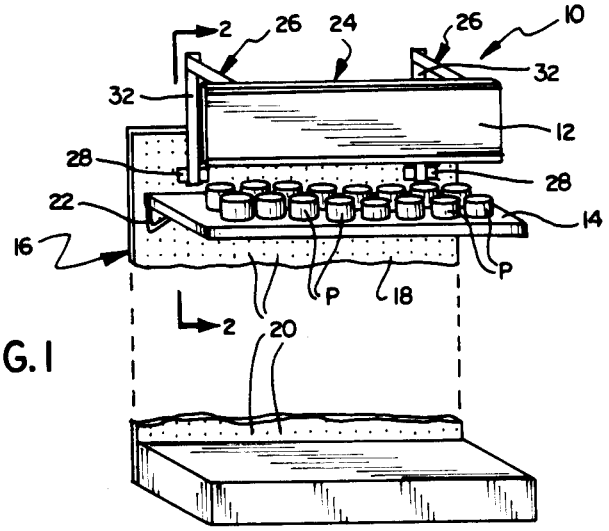
FIG. 1 is a perspective view of a product merchandising display having a header sign supported by a first mounting assembly made in accordance with the present invention.

A first header mounting assembly 10 of the present invention is illustrated in FIG. 1. The first header mounting assembly 10 mounts an elongated header sign 12 above products P which are arranged on a shelf 14 of a product merchandising display 16. The shelves 14 (only one being shown) are supported in cantilevered fashion from a generally vertical support panel 18. The vertical support panel 18 is of the pegboard type having perforations 20 formed therein in columns and rows. Shelf support brackets 22 (only one being shown) attach the shelf 14 to the pegboard panel 18 in a known manner.

The first header mounting assembly 10 includes an elongated header holder 24 for holding the elongated display sign 12. At least one and preferably a substantially identical pair of mounting members 26 mount the header holder 24 from the pegboard panel 18 and above the shelf 14. Each of the mounting members 26 (FIG. 2) includes a lower pegboard attachment bracket 28, an upper header holder support bracket 30, and means interconnecting them in the form of an upright brace 32. The upright brace 32 has a generally vertical, longer portion 34 and a generally horizontal, shorter portion 36 affixed to the upper end of the longer portion 34. The longer portion 34 and shorter portion 36 define an approximate right angle configuration which displaces the header sign 12 outwardly from the panel 18 and above the shelf 14. The upright brace 32 is connected at its lower end to the pegboard attachment bracket 28 and at its upper end to the header holder support bracket 30.

Figure 3:
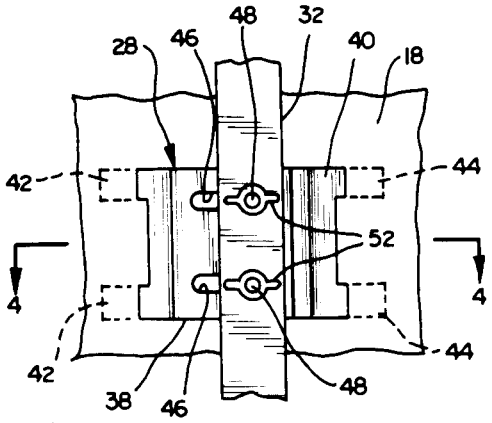
Figure 4:
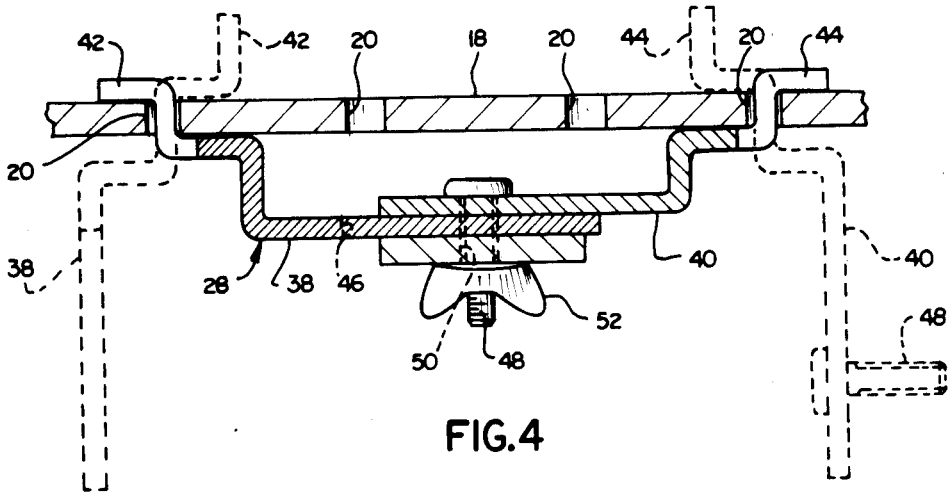

The pegboard attachment bracket 28 includes first and second attaching plates 38, 40 (FIG. 3) having respective leg portions 42, 44. The leg portions 42, 44 of the attaching plates 38, 40 are configured to insert into respective perforations 20 of the panel, as depicted in phantom outline in FIG. 4, for installing the attachment bracket 28 in the pegboard panel 18. The leg portions 42, 44 interengage with the panel 18 upon pivoting the plates into a side-by-side, overlapping relationship with one another, as depicted in solid line form in FIG. 4.

Attachment means is provided in the form of a pair of slots 46 in the first plate 38, a plurality of fasteners in the form of screw studs 48 fixedly mounted in the second plate 40, and a pair of holes 50 defined in the lower end of the upright brace 32. The screw studs 48 are fixed to the plate 40 for convenience of handling and assembly. The screw studs 48 may be provided separate from the plate 40 so as to be insertable through holes therein. The slots 46 and screw studs 48 are aligned on the respective plates 38, 40 so the studs 48 will insert through the slots 46 in the plate 38 and the holes 50 in the lower end of the brace 32. Complementary fasteners in the form of wing nuts 52 are provided which thread onto the ends of the screw studs 48 for securing the overlapped plates 38, 40 and the brace 32 together and for maintaining the leg portions 42, 44 of the plates interengaged with the pegboard panel 18.

Figure 2:
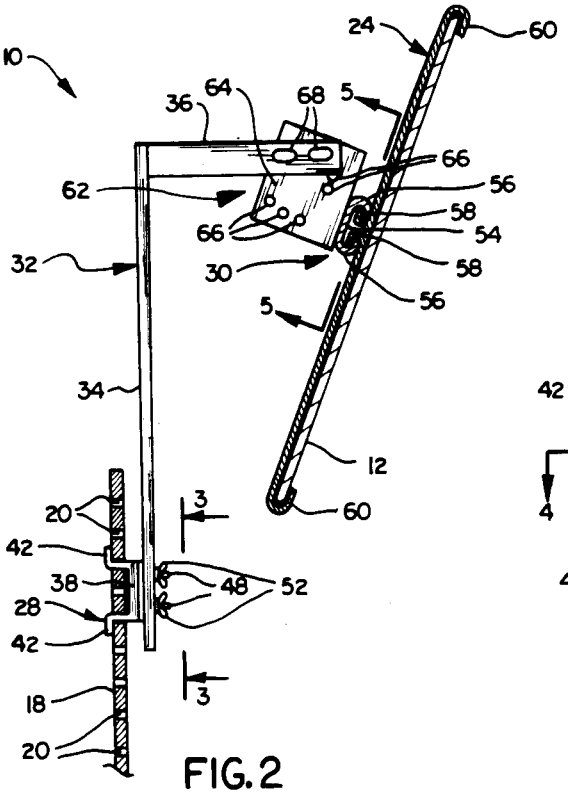
FIGS. 2–6 are views of the parts of the first mounting assembly of FIG. 1.
Figure 6:
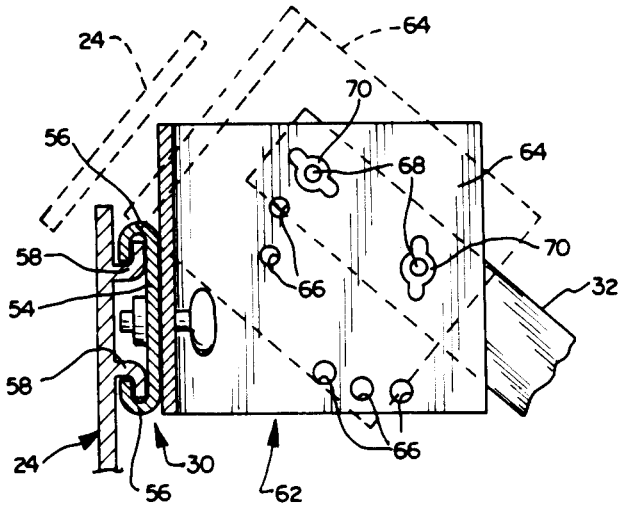
Figure 5:
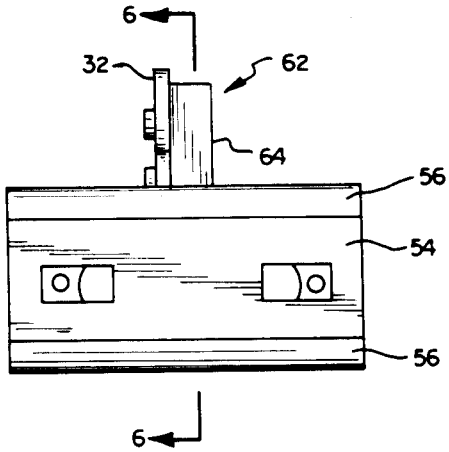

The header holder support bracket 30 includes a plate 54 (FIG. 5) having a pair of spaced tracks 56 for slidably interfitting with complementary tracks 58 (FIG. 6) formed on a rear side of the header holder 24. A pair of upper and lower tracks 60 are formed on the front side of the holder 24 for holding the sign 12, as illustrated in FIG. 2.

Adjustable means 62 (FIG. 6) is provided for adjustably connecting the upper end of the upright brace 32 with the support bracket 30. The adjustable means 62 is capable of varying the angular relationship of the header holder 24 and sign 12 above the top shelf 14. More particularly, the adjustable means 62 interconnects the support bracket plate 54 to the upper end of the upright brace 32 at one of a plurality of angularly displaced positions. The adjustable means 62 includes a plate 64 attached in generally perpendicular relationship to the bracket plate 54 which mounts the tracks 56. The plate 64 has a plurality of holes 66 defined in a pattern allowing the plate to be connected to the upper end of the brace 32 in various angular relationships. The adjustable means 62 also includes a pair of fasteners in the form of screw studs 68 fixedly mounted to the upper end of the brace 32 and insertable into selected plate holes 66 for disposing the tracks 56 in one of the plurality of positions relative to the brace 32. Further, a pair of complementary fasteners in the form of wing nuts 70 are provided which thread on the outer ends of the screw studs 68 for securing the plate 64 and upper end of the upright brace 32 together. While the screw studs 68 are shown fixed to the upright brace 32, they could also be provided separate from the upright brace and insertable through holes therein.

A second header mounting assembly 72 for a product merchandising display 74 is illustrated in FIG. 7. The display 74 includes a generally vertical support panel 76 having a U-shaped end cap 78 (FIGS. 9 and 10) on its upper edge 80 and a series of vertically spaced shelves 82 (FIG. 7, only one shown) for storing products P. The shelves 82 are supported from the vertical support panel 76 by shelf brackets 84. The second mounting assembly 72 supports a pair of header signs 86, 88 facing in opposite directions directly above the upper edge 80 of the support panel 76.

The second header mounting assembly 72 includes a pair of elongated header holders 90, 92, each holding one of the elongated display signs 86, 88 (FIG. 8). The second header sign mounting assembly 72 also includes at least one and preferably a substantially identical pair of mounting members 94 (FIG. 7) for mounting the header holders 90, 92 above the panel upper edge 80 and upper shelf 82.

More particularly, each of the mounting members 94, as best seen in FIGS. 7 to 9, includes a lower end cap clamp 96, an upper header holder support bracket 98, and means interconnecting them in the form of an upright brace 100. The upright brace 100 is connected at its lower end with the end cap clamp 96 and at its upper end with header holder support bracket 98.

As best seen in FIGS. 9 and 10, the lower end cap clamp 96 includes a pair of connecting means in the form of retainer and stud plates 102, 104 respectively. A pair of attaching means in the form of clips 106, 108 are pivotally connected by hinges 110, 112 to the respective retainer and stud plates 102, 104. The clips 106, 108 interfit with legs 114 of the end cap 78 on the top edge 80 of the support panel 76 (FIG. 9).

For installing the clamp 96 on the end cap 78 of the support panel76, the retainer and stud plates 102, 104 (FIG. 10) are pivoted to generally coplanar relationships with the corresponding clips 106, 108 and a parallel displaced relationship to one another. The clips 106, 108 are then aligned with the end cap legs 114 for inserting and interfitting the clips thereon. The legs 114 are received in the grooves 116 formed by the U-shaped configuration of the clips. Then, the retainer and stud plates 102, 104 are pivoted through about ninety degrees toward one another from the position illustrated in FIG. 10 to the position illustrated in FIG. 9. The generally parallel overlapped and adjacent relationship of the plates 102, 104 to one another result for attaching the plates together and to the lower end of the upright brace 100. As seen in FIG. 11, the retainer plate 102 has a central opening 118 which receives an upturned stud 120 (FIG. 10) when the plates are overlapped. The stud 120 is then secured to the lower end of the brace 100 by a fastener in the form of a screw 122.

The header holder support bracket 98 (FIG. 8) of each of the mounting members 94 includes a plate 124 with a pair of spaced tracks 126 disposed on each opposite side of the upright brace 100 in back-to-back opposite facing relationship. The pairs of tracks 126 are adapted to slidably interfit with complementary rear tracks 128 on the header holders 90, 92 for supporting the head holders. A pair of upper and lower tracks 130 are formed on the front side of each of the holders 90, 92 for holding the signs 86, 88 facing in opposite directions.

Figure 12:
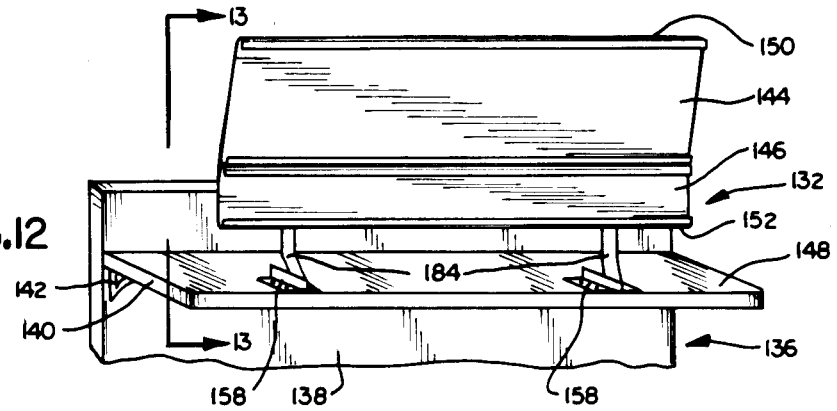
FIG. 12 is a perspective view of still another product merchandising display incorporating a third mounting assembly of the present invention.
Figure 14:
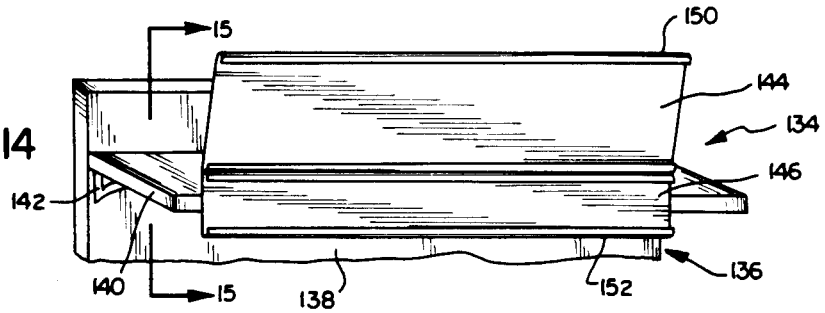
FIG. 14 is a perspective view of a header sign supported on the display shelf by a modified form of a third mounting assembly of FIG. 12.

Two forms of a third header sign mounting assembly designated respectively as 132, 134 are illustrated in FIGS. 12 and 14. Each mounting assembly 132, 134 is applied to a product merchandising display 136 which includes a generally vertical support panel 138 and a series of vertically spaced shelves 140 (only one shown) for displaying products P. The shelves 140 are supported from the panel 138 by shelf brackets 142. Each of the third mounting assemblies 132, 134 supports a pair of header signs 144, 146 in a vertically disposed tandem relationship from the respective front edge 148 of the shelf 140.

Figure 13:
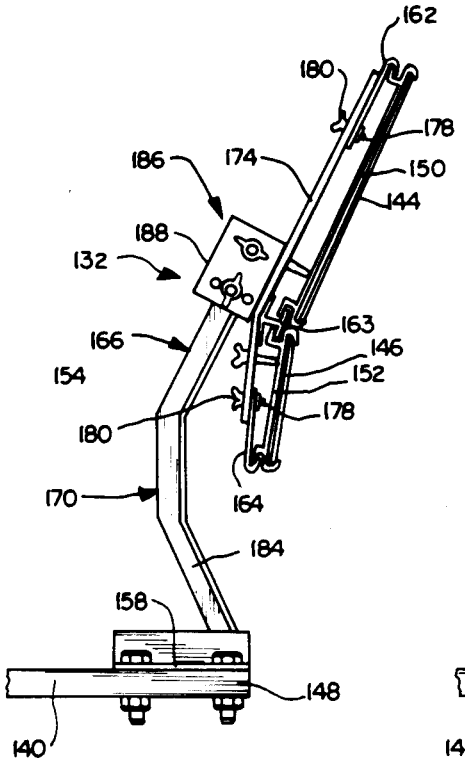
FIG. 13 is an enlarged side view of a member of the third mounting assembly as seen along line 13—13 of FIG. 1.
Figure 15:
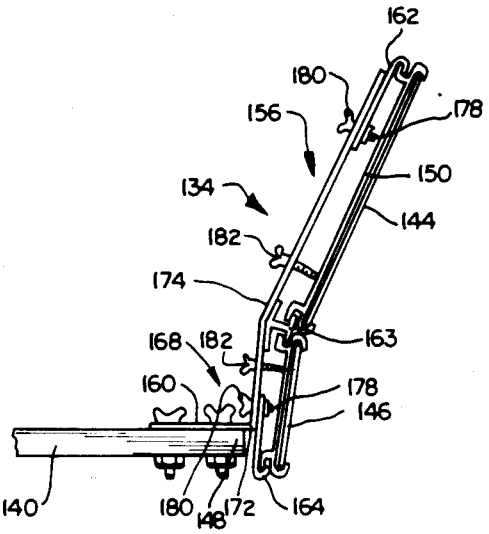
FIG. 15 is an enlarged side view of a member of the modified third mounting assembly as seen along line 15—15 of FIG. 14.

Each of the third mounting assemblies 132, 134 includes upper and lower elongated header holders 150, 152 for holding the respective elongated display signs 144, 146. The mounting assembly 132 shown in FIG. 12 has at least one and preferably a substantially identical pair of mounting members 154 (FIG. 13) mounting the header holders 150, 152 in the vertical tandem relationship above the shelf 140. The modified mounting assembly 134 (FIG. 14) has at least one and preferably a substantially identical pair of mounting members 156 (FIG. 15) for mounting the header holders 150, 152 in the vertical tandem relationship in front of the shelf 140.

The mounting members 154, 155 (FIGS. 13 and 15, respectively) include respective shelf attachment brackets 158, 160 which differ slightly from one another, upper and lower header holder supports 162, 164 which are identical in both members, and respective intermediate header holder supports 166, 168 which differ from one another. The intermediate header holder supports 166, 168 have respective first portions 170, 172 connected to the respective shelf attachment brackets 158, 160 and a second portion 174 disposed between the upper and lower header holder supports 162, 164.

Figure 16:
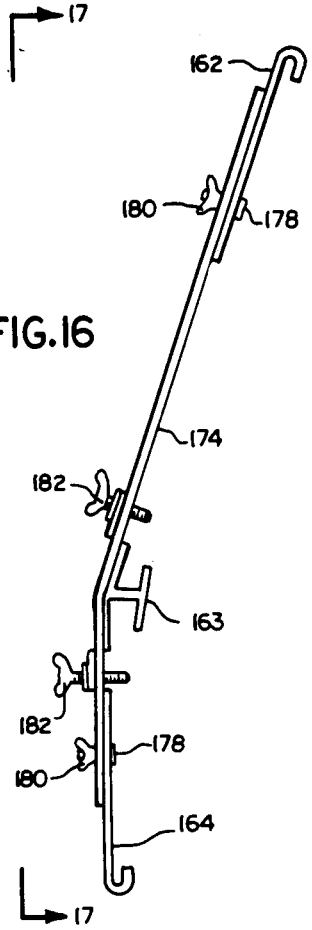
FIGS. 16–17 are views of a header holder support of the third mounting assembly.
Figure 17:
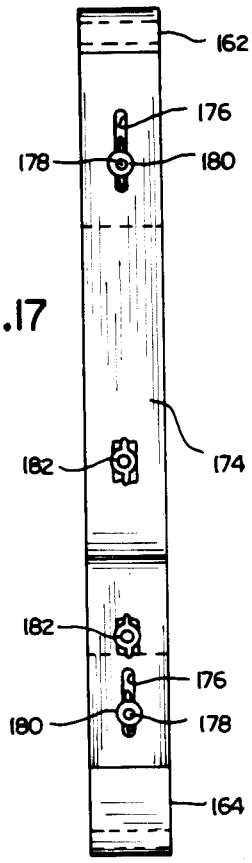

The second portion 174 (FIGS. 16 and 17) of each intermediate support 166, 168 has a stationary middle header holder support 163. The middle header holder support 163 is adjustably connected to the upper and lower header holder supports 162, 164 for varying the distance therebetween and thereby the size of said header holders 150, 152 mounted by the members 154, 156 and the size of the signs 144, 146 held by the holders. Specifically, the second portions 174 have upper and lower slots 176 which adjustably receive outer ends of the screws 178 attached to the upper and lower supports 162, 164 to which wing nuts 180 are threaded. Screws 182 are also threadably mounted through the second portion 174 to bear against the header holders 150, 152 to retain them in stationary positions.

Figure 19:
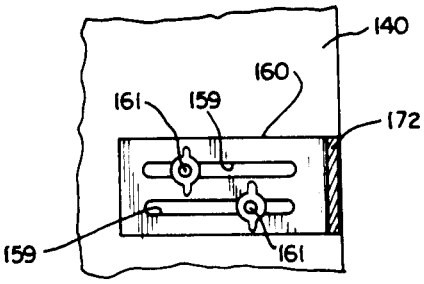
FIG. 19 is an enlarged top view of the shelf attachment bracket of the modified third mounting assembly of FIG. 15.

In the mounting member 156 (FIG. 15), the first portion 172 of the intermediate header holder support 168 is simply a rigid connection between the shelf attachment bracket 160 and the lower end of the support 168. The first portion 172 (FIG. 19) is horizontally adjustable relative to the shelf 140. Specifically, the bracket 160 has a pair of slots 159 therein. The slots 159 have fasteners 161 extending therethrough. The fasteners 161 also extend through the shelf 140 and releasably connect the bracket 160 to the shelf 140 for adjusting the relative position therebetween.

In the mounting member 154 (FIG. 13), the first portion 170 of the intermediate header holder support 166 is in the form of an arcuate-shaped upright brace 184 and adjustable means 186. The brace 184 extends between and is connected at its lower end with the shelf attachment bracket 158 and at its upper end with the second portion 174 of the intermediate header holder support 166. The adjustable means 186 adjustably connects the brace 184 at its upper end with the second portion 174 of the intermediate support 166 for varying the angular position of the header holders 150, 152.

Figure 18:
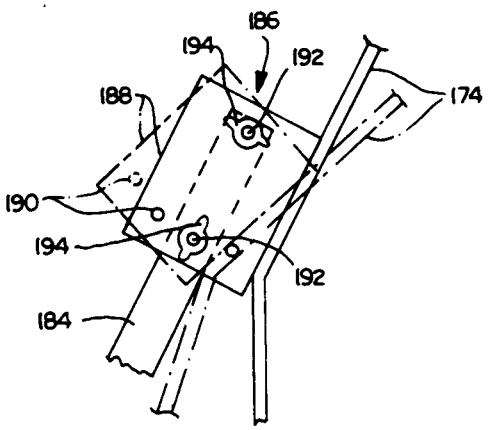
FIG. 18 is an enlarged side view of the header holder support bracket of third mounting assembly of FIG. 13.

More particularly, the adjustable means 186 (FIG. 18) includes a plate 188 attached to the second portion 174 of the intermediate header holder support 166. The plate 188 has a plurality of holes 190 defined in a pattern which allows the plate to be connected to the upper end of the brace 184 in various angular relationships. The adjustable means 186 also includes a pair of fasteners in the form of screw studs 192 fixedly mounted to the upper end of the brace 184 and insertable into selected plate holes 190. The second portion 174 of the intermediate header holder support 164 is thereby selected to be in one of a plurality of positions relative to the brace 184. Further, a pair of complementary fasteners in the form of wing nuts 194 are provided which thread on the end of the screw studs 192 for securing the plate 188 and the upper end of the brace 184 together. While the screw studs 192 are shown fixed to the brace 184, they could also be provided separate from brace so as to be insertable through holes therein.

It is thought that the header sign mounting assemblies of the present invention and many of their attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having described at least one preferred embodiment, I claim:

1. A header sign mounting assembly for a product merchandising display wherein the display includes a generally vertical pegboard support panel and at least one shelf for arranging products thereon, said mounting assembly comprising:

(a) a header holder for holding a display sign; and (b) means for mounting said header holder on the pegboard support panel, said mounting means comprising:

(i) a support bracket for supporting said header holder, (ii) an upright brace for supporting said support bracket relative to the pegboard support panel, said upright brace having lower and upper ends, (iii) an attachment bracket for detachably connecting said upright brace with said pegboard support panel, (iv) first means for connecting said upright brace with said attachment bracket at the lower end of said upright brace, and (v) second means for connecting said upright brace with said support bracket at the upper end of said upright brace;

said attachment bracket comprising a pair of plates having leg portions adapted to be inserted into the pegboard support panel and then interengage therewith upon pivoting said plates into an overlapping relationship, said first connecting means comprising attachment means adapted to interfit with said plates and said lower end of said upright brace after said plates have been positioned in the overlapping relationship, engaging with said attachment means to secure said plates and said mounting assembly further including complementary means for said lower end of said upright brace together to maintain said leg portions of said plates interengaged with the pegboard support panel.

2. A header sign mounting assembly for a product merchandising display wherein the display includes a generally vertical pegboard support panel and at least one shelf for arranging products thereon, said mounting assembly comprising:

(a) a header holder for holding a display sign; and (b) means for mounting said header holder on the pegboard support panel, said mounting means comprising:

(i) a support bracket for supporting said header holder, (ii) an upright brace for supporting said support bracket relative to the pegboard support panel, said upright brace having lower and upper ends, (iii) an attachment bracket for detachably connecting said upright brace with said pegboard support panel, (iv) first means for connecting said upright brace with said attachment bracket at the lower end of said upright brace, and (v) second means for connecting said upright brace with said support bracket at the upper end of said upright brace;

said attachment bracket comprising a pair of plates having leg portions adapted to be inserted into the pegboard support panel and then interengage therewith upon pivoting said plates into an overlapping relationship, said first connecting means comprising attachment means adapted to interfit with said plates and said lower end of said upright brace after said plates have been positioned in the overlapping relationship, said mounting assembly further including complementary means for engaging with said attachment means to secure said plates and said lower end of said upright brace together to maintain said leg portions of said plates interengaged with the pegboard support panel;

said lower end of said upright brace having a plurality of holes therein, said plates having a plurality of slots therein, said attachment means comprising a plurality of first fasteners for inserting through said slots after said plates are pivoted to the overlapping relationship and through said holes after said lower end of said upright brace is disposed adjacent said overlapped plates, and said complementary means comprising a plurality of second fasteners for threading onto said first fasteners for securing said plates and said lower end of said upright brace together.

3. A header sign mounting assembly for a product merchandising display wherein the display includes a generally vertical pegboard support panel and at least one shelf for arranging products thereon, said mounting assembly comprising:

(a) a header holder for holding a display sign; and (b) means for mounting said header holder on the pegboard support panel, said mounting means comprising:

(i) a support bracket for supporting said header holder, (ii) an upright brace for supporting said support bracket relative to the pegboard support panel, said upright brace having lower and upper ends, (iii) an attachment bracket for detachably connecting said upright brace with said pegboard support panel, (iv) first means for connecting said upright brace with said attachment bracket at the lower end of said upright brace, and (v) second means for connecting said upright brace with said support bracket at the upper end of said upright brace;

said attachment bracket comprising a pair of plates having leg portions adapted to be inserted into the pegboard support panel and then interengage therewith upon pivoting said plates into an overlapping relationship, said first connecting means comprising attachment means adapted to interfit with said plates and said lower end of said upright brace after said plates have been positioned in the overlapping relationship, said mounting assembly further including complementary means for engaging with said attachment means to secure said plates and said lower end of said upright brace together to maintain said leg portions of said plates interengaged with the pegboard support panel;

said lower end of said upright brace having a plurality of holes therein, one of said plates having a plurality of slots therein, said attachment means comprising a plurality of fasteners mounted on the other of said plates for insertion through said slots after said plates are pivoted to the overlapping relationship and through said holes after said lower end of said upright brace is disposed adjacent said overlapped plates, and said complementary means comprising a plurality of second fasteners for threading onto said first fasteners for securing said plates and said lower end of said upright brace together.

4. A mounting assembly as set forth in claim 3, wherein said mounting means comprises two support brackets, two upright braces, and two attachment brackets.

5. A header sign mounting assembly for a product merchandising display wherein the display includes a generally vertical pegboard support panel and at least one shelf for arranging products thereon, said mounting assembly comprising:

(a) a header holder for holding a display sign; and (b) mounting means for mounting said header holder on the pegboard support panel, said mounting means comprising:

(i) a support bracket for supporting said header holder, (ii) an upright brace for supporting said support bracket relative to the pegboard support panel, said upright brace having lower and upper ends, (iii) an attachment bracket for detachably connecting said upright brace with said pegboard support panel, (iv) first means for connecting said upright brace with said attachment bracket at the lower end of said upright brace, and (v) second means for connecting said upright brace with said support bracket at the upper end of said upright brace;

said header holder support bracket comprising a pair of spaced tracks for slidably interfitting with complementary tracks on said header holder, said second means for connecting said spaced tracks to said upper end of said brace at a selected one of a plurality of angularly displaced positions.

6. A mounting assembly as recited in claim 5 wherein said header holder support bracket comprises a plate attached to said tracks and having a plurality of holes therein, and said second means comprises a plurality of first fasteners mounted to said upper end of said upright brace and insertable into selected ones of said plate holes for disposing said tracks in said selected one of said pluraltiy of angularly displaced positions, and a plurality of second fasteners for threading onto said first fasteners for securing said plate and said upper end of said upright brace together.

* * * * *